US009091109B2

(12) United States Patent
Busch et al.

(10) Patent No.: US 9,091,109 B2
(45) Date of Patent: Jul. 28, 2015

(54) REVOLVING DOOR WITH A DRIVE UNIT ARRANGED AT A GLASS CEILING ELEMENT

(71) Applicants: Sven Busch, Dortmund (DE); Stefan Kissler, Leverkusen (DE); Thomas Schmitz, Wesseling (DE)

(72) Inventors: Sven Busch, Dortmund (DE); Stefan Kissler, Leverkusen (DE); Thomas Schmitz, Wesseling (DE)

(73) Assignee: Dorma Deutschland GmbH, Ennepetal (DE)

( * ) Notice: Subject to any disclaimer, the term of this patent is extended or adjusted under 35 U.S.C. 154(b) by 5 days.

(21) Appl. No.: 14/154,433

(22) Filed: Jan. 14, 2014

(65) Prior Publication Data

US 2014/0196374 A1 Jul. 17, 2014

(30) Foreign Application Priority Data

Jan. 14, 2013 (DE) ..... 10 2013 000 423

(51) Int. Cl.

| | |
|---|---|
| ***E05F 15/10*** | (2006.01) |
| ***E06B 11/08*** | (2006.01) |
| ***E05F 15/60*** | (2015.01) |
| ***E05F 15/608*** | (2015.01) |

(52) U.S. Cl.

CPC ..... *E05F 15/106* (2013.01); *E05F 15/60* (2015.01); *E05F 15/608* (2015.01); *E06B 11/08* (2013.01); *E05Y 2201/438* (2013.01); *E05Y 2201/442* (2013.01); *E05Y 2201/446* (2013.01); *E05Y 2600/45* (2013.01); *E05Y 2900/132* (2013.01)

(58) Field of Classification Search

CPC ..... E05F 15/106; E05F 15/60; E05F 15/608; E06B 11/08; E05Y 2900/132; E05Y 2201/442; E05Y 2201/438; E05Y 2600/45; E05Y 2201/446

USPC ..... 49/42–47

See application file for complete search history.

(56) References Cited

U.S. PATENT DOCUMENTS

| | | | | | |
|---|---|---|---|---|---|
| 2,007,213 | A | * | 7/1935 | Peremi et al. | 49/45 |
| 2,050,584 | A | * | 8/1936 | Peremi et al. | 49/43 |
| 2,136,323 | A | * | 11/1938 | Shields | 362/147 |
| 2,186,385 | A | * | 1/1940 | Lockart | 292/33 |
| 2,341,545 | A | * | 2/1944 | Hagenbook | 49/42 |
| 2,523,980 | A | * | 9/1950 | Whiteford | 49/44 |
| 3,349,876 | A | * | 10/1967 | Sheckells | 188/185 |
| 3,364,620 | A | * | 1/1968 | Hess et al. | 49/43 |
| 3,736,701 | A | * | 6/1973 | Rush et al. | 49/44 |
| 3,766,686 | A | * | 10/1973 | Sheckells | 49/43 |
| 3,897,651 | A | * | 8/1975 | Sheckells | 49/43 |
| 4,332,108 | A | * | 6/1982 | Appelmann | 49/44 |
| 4,341,165 | A | * | 7/1982 | Calandritti et al. | 109/8 |
| 4,358,909 | A | * | 11/1982 | Trikilis | 49/42 |
| 4,458,447 | A | * | 7/1984 | Heise et al. | 49/44 |
| 4,557,073 | A | * | 12/1985 | Sandling | 49/41 |
| 4,627,193 | A | * | 12/1986 | Schwarz | 49/42 |

(Continued)

FOREIGN PATENT DOCUMENTS

| | | |
|---|---|---|
| DE | 197 11 460 | 11/1997 |
| EP | 2 072 737 | 6/2009 |

*Primary Examiner* — Katherine Mitchell
*Assistant Examiner* — Justin Rephann
(74) *Attorney, Agent, or Firm* — Cozen O'Connor

(57) ABSTRACT

A revolving door with a drive unit drivingly connected to a turnstile of the revolving door. The revolving door has at least one glass ceiling element. The drive unit is gearlessly constructed and has an electronically commutated multipole motor. The multipole motor is arranged at the glass ceiling element.

13 Claims, 2 Drawing Sheets

(56) References Cited

U.S. PATENT DOCUMENTS

| | | | | | |
|---|---|---|---|---|---|
| 4,660,322 | A | * | 4/1987 | Lowe | 49/44 |
| 4,763,053 | A | * | 8/1988 | Rabe | 318/400.41 |
| 4,874,975 | A | * | 10/1989 | Hertrich | 310/186 |
| 4,970,825 | A | * | 11/1990 | Knarvik | 49/44 |
| 4,976,065 | A | * | 12/1990 | Beran et al. | 49/43 |
| 5,634,295 | A | * | 6/1997 | Bunzl | 49/45 |
| 5,773,943 | A | * | 6/1998 | Andersen | 318/432 |
| 5,825,901 | A | * | 10/1998 | Hisey | 381/165 |
| 6,266,922 | B1 | * | 7/2001 | Rockenbach | 49/42 |
| 8,136,297 | B2 | * | 3/2012 | Bzorgi | 49/43 |
| 2008/0028682 | A1 | * | 2/2008 | Casella et al. | 49/25 |
| 2008/0047200 | A1 | * | 2/2008 | Krause et al. | 49/31 |
| 2008/0244978 | A1 | * | 10/2008 | Soyugenc | 49/42 |
| 2009/0188166 | A1 | * | 7/2009 | Taheri et al. | 49/31 |
| 2009/0189560 | A1 | * | 7/2009 | Taheri et al. | 318/445 |
| 2009/0206777 | A1 | * | 8/2009 | Taheri et al. | 318/15 |
| 2012/0005961 | A1 | * | 1/2012 | Busch et al. | 49/46 |

* cited by examiner

REVOLVING DOOR WITH A DRIVE UNIT ARRANGED AT A GLASS CEILING ELEMENT

BACKGROUND OF THE INVENTION

1. Field of the Invention

The present invention is directed to a revolving door with a drive unit drivingly connected to a turnstile of the revolving door, wherein the revolving door has at least one glass ceiling element.

2. Description of the Related Art

A generic revolving door with a drive unit which is drivingly connected to a turnstile of the revolving door is known from DE 197 11 460 A1. The drive unit is floor-mounted and drives the turnstile of the revolving door by a gearbox by a motor. The large structural dimensions of the motor and gearbox for driving the turnstile prohibit ceiling-side mounting because the revolving door has a glass ceiling element. The turnstile of the revolving door comprises a plurality of revolving wings that reach to the underside of the glass ceiling element, and the revolving wings are connected to one another in a common rotational axis by swing arms. The diagram shows the filigree construction of a glass ceiling element at which facade elements abut above the revolving door. An arrangement of the drive unit below or above the glass ceiling element for driving the turnstile of the revolving door would not be possible without a considerable expenditure.

EP 2 072 737 A2 shows a revolving door with a drive unit drivingly connected to a turnstile of the revolving door. The drive unit is ceiling-mounted. A revolving door construction of this kind illustrates the installation space required for integrating the drive unit above the turnstile. This type of arrangement of the drive unit combined with a filigree glass ceiling element of the revolving door cannot be reasonably implemented.

SUMMARY OF THE INVENTION

An object of one embodiment of the invention is a revolving door with a drive unit, wherein the revolving door has a glass ceiling element and has an improved arrangement and/or construction of a drive unit.

According to one embodiment, of the invention comprises a drive unit that is gearlessly constructed and has an electronically commutated multipole motor, wherein the multipole motor is arranged at the glass ceiling element.

The invention is based on the idea of taking advantage of the specific geometrical dimensions of a multipole motor by arranging the multipole motor at the glass ceiling element. Multipole motors are also known as torque motors and, due to their multipole construction, have a very high torque even at very low rotational speeds. Accordingly, the drive unit can be constructed gearlessly and the multipole motor can be directly connected to the turnstile without the intermediary of a gearbox. Therefore, the rotating part of the multipole motor has the same rotational speed as the turnstile of the revolving door and can have a drive axis coinciding with the rotational axis of the turnstile.

An advantage achieved by embodying the drive unit as an electronically commutated multipole motor is that the small structural dimensions of the multipole motor allow the drive unit to be arranged at the glass ceiling element without the drive unit having, for example, an excessive weight that cannot be supported by a glass ceiling element. A further advantage which is achieved consists in that a filigree-like glass ceiling element need not be structurally combined with a drive unit of large dimensions, which offers advantages particularly with respect to the construction of the building facade bordering the revolving door.

The revolving door has a frame and the canopy of the frame of the revolving door can be partially or entirely formed of glass. The glass ceiling element can form a part of the canopy or the entire canopy of the frame of the revolving door. The drive unit in the form of a multipole motor can also be arranged at more than one individual glass ceiling element. For example, the canopy of the revolving door can have round dimensions and be formed of a plurality of glass ceiling elements which are put together in halves or equally, for example, or the canopy of the frame can be formed of a plurality of glass ceiling elements in the shape of pie slices. In this respect, the invention provides the arrangement of the drive unit particularly in the center of the circularly shaped canopy of the revolving door made of glass. Accordingly, the glass canopy can be constructed either as a frameless all-glass canopy, as a framed glass canopy or as a part-glass canopy and can comprise one or more glass ceiling elements.

In a particularly advantageous manner, the multipole motor can be arranged at the underside of the glass ceiling element. This achieves the advantage that the drive unit is protected from environmental influences. Therefore, no sealing work is required because the multipole motor is already protected against moisture and other environmental influences by the at least one glass ceiling element. If the drive unit were mounted above the glass ceiling element or in the extension plane of the glass ceiling element, an additional sealing step would be needed to protect against climatic influences. A further advantage of the arrangement of the multipole motor at the underside of the glass ceiling element consists in that the overall construction of the revolving door can terminate on top with the at least one glass ceiling element. Accordingly, a further facade construction can adjoin the revolving door in a correspondingly simple manner and the revolving door can be integrated in a simple manner in the facade construction.

The multipole motor can have a substantially round, flat base structure, a disk-shaped or cup-shaped stator part and a disk-shaped or cup-shaped rotor part which is arranged in a plane parallel relative to the stator part. In particular, either the stator part or the rotor part can be disk-shaped or cup-shaped and when one of the two parts has a cup shape it can substantially enclose the disk shape of the other part. The coplanarity of the cup-shaped part relative to the disk-shaped part refers to a base area of the cup-shaped part which extends in a plane parallel to the disk shape of the other part.

In a further advantageous manner, the multipole motor can have a quantity of coil elements and a quantity of magnet elements, and the coil elements and the magnet elements are arranged in an area between the stator part and the rotor part. When at least one of the parts is cup-shaped and is enclosed by another part which is disk-shaped, this results in a compact construction of the multipole motor with magnets and coils integrated between the disk shape and the cup shape. Since the coil elements must be electrically contacted, it is advantageous that they are received in the stationary stator part. Conversely, the magnet elements can be arranged at the rotating rotor part.

Connections that connect the stator part of the multipole motor to the glass ceiling element can be provided for a further advantageous configuration of the revolving door. For example, the connections can be formed as point-mount glass fasteners that include in particular at least one screw element and a sleeve element. The sleeve element can be guided through an opening arranged in the stator part and the screw element can have a conical head which is inserted into a conical receptacle in the glass ceiling element. At the same time, the conical receptacle forms an opening and guide-through for the screw element. The conical receptacle in the glass ceiling element can also carry out a sealing function so that moisture and dirt on top of the glass ceiling element which may be exposed to weather is prevented from reaching the underside of the glass ceiling element.

The turnstile of the revolving door can have two or more revolving wings and the revolving wings can be connected directly to the rotor part of the multipole motor. For example, the revolving wings can be arranged at the planar outer side, i.e., flat against the planar base side of the cup-shaped rotor part. To this end, screw elements can be provided, for example, for screwing the revolving wings to the rotor part. In particular, the revolving wings can comprise frame profiles in which glass elements are framed, and the screw connection can be arranged between the frame profiles and the rotor part. In a particularly advantageous manner, the rotor part can have a cup shape with a disk-shaped base segment facing in direction of the revolving wings of the turnstile. In particularly, this results in an especially simple connection between the revolving wings and the rotor part of the multipole motor because no additional connection elements, for example, shafts of the like, need be used when the revolving wings are connected directly to the base segment of the cup-shaped rotor part.

According to one embodiment of a connection shape between the rotor part and the revolving wings, the rotor part can be cup-shaped and comprise a circumferential cup surface portion. In this case, the revolving wings can also be connected in an advantageous manner at the outer side to the cup surface portion of the cup-shaped rotor part, for example, by screw elements.

The flat, particularly disk-shaped construction of the multipole motor results in a very small ratio of height to diameter of the drive unit. For example, the ratio of height to diameter of the round, flat base structure of the electronically commutated multipole motor can be at least 1:3, preferably at least 1:4, particularly preferably at least 1:5, and most preferably 1:8 or more. The greater the ratio of height to diameter, the flatter the base structure of the multipole motor and the shorter the distance between the top of the revolving wings and the underside of the glass ceiling element. This distance may be bridged by brush elements, for example, which can be arranged at the top of the revolving wings and brush against the underside of the glass ceiling element.

"Disk-shaped" means a flat cylinder in which the diameter is many times greater than the height. For example, the multipole motor can have a diameter of approximately 500 mm and a height of only about 40 mm. Further, the characterizing feature of a disk shape also applies when a multipole motor with a primarily disk-shaped configuration is intentionally changed to another similar shape. For example, a flat, polygonal frustum can surround the round stator part or rotor part which are round per se or, for example, the stator part or the rotor part has a shape which is not round and which deviates from a dish shape, for example, a flat cube. A reshaping of this kind can be carried out by enclosing the rotor part or stator part with a correspondingly shaped housing or by reshaping the coil cores in a corresponding manner.

According to embodiment of the electronically commutated multipole motor, the rotor part can be bearing-mounted at the stator part so as to be rotatable around a drive axis. "Drive axis" means an imaginary axis of rotation of the rotor part. In particular, at least one bearing, particularly at least one axial bearing and/or at least one radial bearing can be arranged between the stator part and the rotor part. In a particularly advantageous manner, the axial bearing can have increased dimensions so that ceiling loads acting on the multipole motor from the glass ceiling element can be supported by the axial bearing. Consequently, these ceiling loads can be transferred via the axial bearing through the multipole motor into the turnstile and can be absorbed by a further bearing arrangement in the base area of the turnstile.

The multipole motor can have at least one rotary feedthrough by which electric elements arranged in a stationary manner in the multipole motor can be electrically connected by at least one electric lead. For example, sensors or emergency switches can be installed in the turnstile of the revolving door and electrically connected to the electric elements which are arranged in a stationary manner in the multipole motor. The electric elements can form a control unit, for example, which serves to control the multipole motor. Similarly, it is also conceivable to connect all of the electrical connections, also including the power supply and further external control lines and signal lines of the multipole motor, through the rotary feedthrough by the electric lead so that the multipole motor can be integrated in the glass ceiling element without additional, unsightly electric leads. All of the electrical connections are carried out, for example, via the rotary feedthrough and through a center column of the turnstile, and a further rotary feedthrough through which the electric lead can be guided in a stationary manner into a further, adjoining base portion can be installed in the base area of the turnstile.

Accordingly, the entire power supply and signal supply of the multipole motor can be implemented via the base area on which the revolving door is arranged in spite of a ceiling mounting.

The multipole motor can have a position encoder or angle encoder serving for commutation and for determining angular positions and the rotating speed of the turnstile.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the following, further steps improving the invention are explained in more detail in connection with the description of a preferred embodiment example of the invention with reference to the drawings. The drawings show.

DETAILED DESCRIPTION OF THE PRESENTLY PREFERRED EMBODIMENTS

Figure 1:
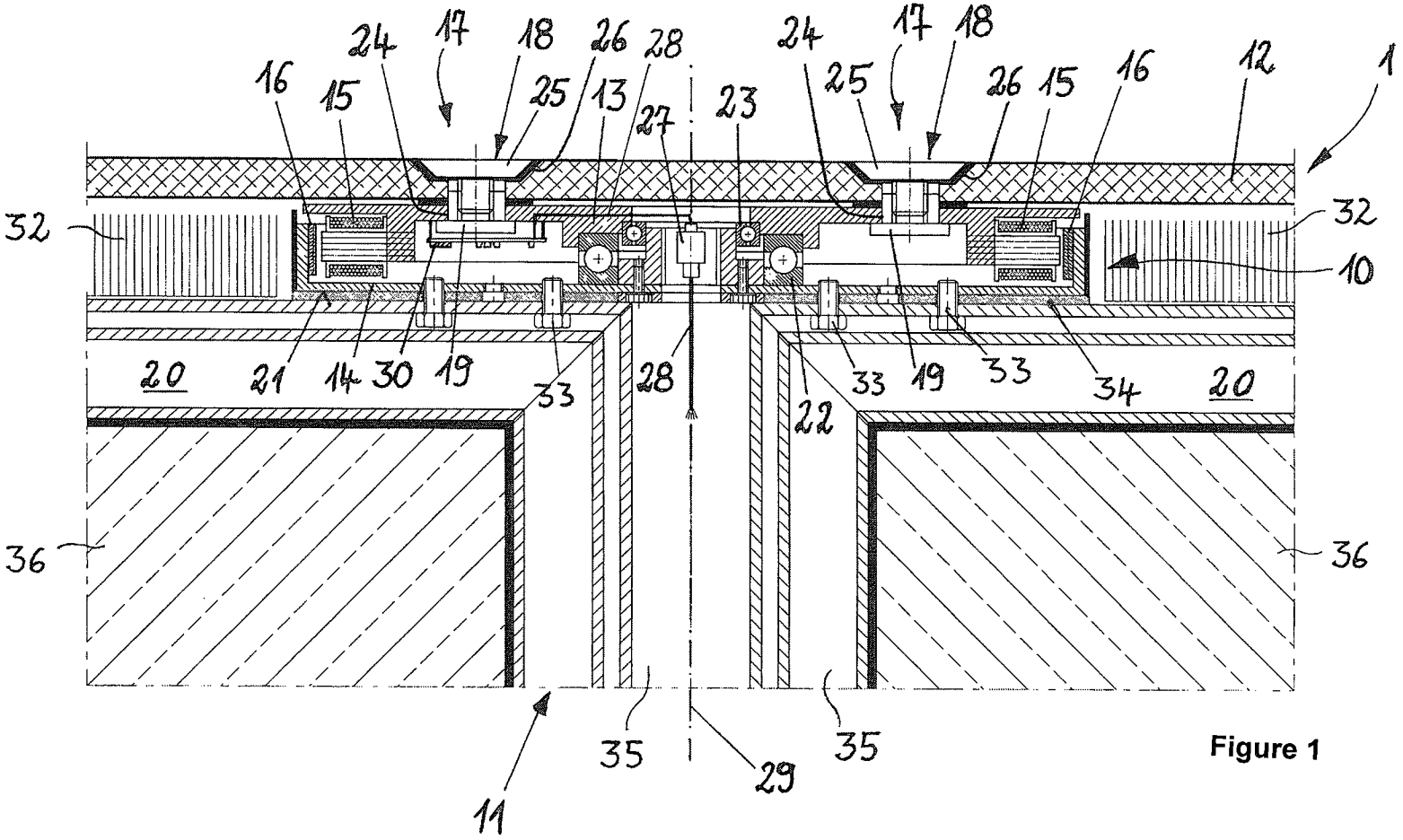
FIG. 1 is a cross-sectional view of a revolving door with a multipole motor in a ceiling-mounted position.

FIG. 1 shows a cross-sectional view of a revolving door 1 with a drive unit which is drivingly connected to a turnstile 11 of the revolving door 1. A section of the revolving door 1 is shown in the upper, ceiling-side area, wherein the ceiling is formed, by way of example, by an individual glass ceiling element 12. The drive unit is formed by an electronically commutated multipole motor 10 which is arranged, according to the invention, at the glass ceiling element 12 between the glass ceiling element 12 and the turnstile 11. Consequently, the multipole motor 10 is shown arranged below the glass ceiling element 12 by way of example. The electronically commutated multipole motor 10 will be described in more detail in the following.

The electronically commutated multipole motor 1 comprises a stator part 13 and a rotor part 14. The stator part 13 is formed so as to be disk-shaped and round, for example, and the rotor part 14 is cup-shaped, for example, and is arranged at the underside of the stator part 13. A plurality of coil elements 15 and magnet elements 16 are located between the stator part 13 and the rotor part 14 and are arranged on a circular path around the drive axis 29. Only two coil elements 15 and two magnet elements 16 are shown in the cross-sectional view. The coil elements 15 are received at the stator part 13 and the magnet elements 16 are received at the rotor part 14.

The multipole motor 10 has a flat, substantially disk-shaped configuration extending around the drive axis 29. Consequently, a plurality of coil elements 15 are distributed around the drive axis 29, and a plurality of magnet elements 16 which are similarly distributed around the drive axis 29 are located on the inner side in the cup-shaped rotor part 14. Because of the external arrangement of the magnet elements 16 with respect to the coil elements 15, the multipole motor 10 is formed as an outrunner or external rotor so that a particularly high torque can be achieved by the multipole motor 10.

A control unit 30 provides for electronic commutation of the coil elements 15 to generate a magnetic field rotating around the drive axis 29, this control unit 30 likewise being arranged in the installation space between the stator part 13 and the rotor part 14.

The stator part 13 is connected to the glass ceiling element 12 by connection elements 17. The connection elements 17 are formed, for example, as point-mount glass fasteners and include a screw element 18 and a sleeve element 19. The screw element 18 has a conical head 25 which sealingly fits into a conical receptacle 26 arranged in the glass ceiling element 12. The conical receptacle 26 is adjoined by an opening in the glass ceiling element 12 so that the screw element 18 can be inserted through the opening. An opening 24 in the stator part 13 faces the respective opening in the glass ceiling element 12, the sleeve element 19 being guided through this opening 24 and the screw element 18 is screwed into the sleeve element 19. Only two connection elements 17 are shown in the cross-sectional view. More than two connection elements 17 can be provided between the multipole motor 10 and the glass ceiling element 12 particularly so as to be distributed around the drive axis 29.

The turnstile 11 is shown with two revolving wing 20. Three, four or more revolving wings 20 can form the turnstile 11 of the revolving door 1, for example. The embodiment example shows a direct connection of the revolving wings 20 to the rotor part 14 of the multipole motor 10 by screw elements 33. The revolving wings 20 have profile frames 35 and glass elements 36; screw elements 33 connect the profile frames 35 of the revolving wings 20 to the rotor part 14. A bezel element 34 which covers the underside of the rotor part 14 is arranged, for example, between the revolving wings 20 and the rotor part 14.

An electric lead 28 is provided for electrically connecting the control unit 30 arranged in a stationary manner in the stator part 13. A rotary feedthrough 27 integrated in the multipole motor 10 is incorporated in the electric lead 28. Accordingly, the electric lead 28 is divided into a stationary part of the lead 28, between the rotary feedthrough 27 and the control unit 30 within the multipole motor 10 and a part of the electric lead 28 which is outside of the multipole motor 10 and which rotates along with the turnstile 11.

The rotor part 14 is mounted at the stator part 13 so as to be rotatable around the drive axis 29 by an axial bearing 22 and a radial bearing 23. The axial bearing 22 is shown with increased dimensions so that ceiling loads which can act on the glass ceiling element 12 from the outside can be supported via the axial bearing 22 through the multipole motor 10 into the turnstile 11.

Brush elements 32, which can brush along the underside of the glass ceiling element 12 when the turnstile 11 rotates around the drive axis 29, are arranged at the revolving wings 20 to bridge the vertical gap between the top of the revolving wings 20 and the underside of the glass ceiling element 12 lateral to the multipole motor 10.

Figure 2:
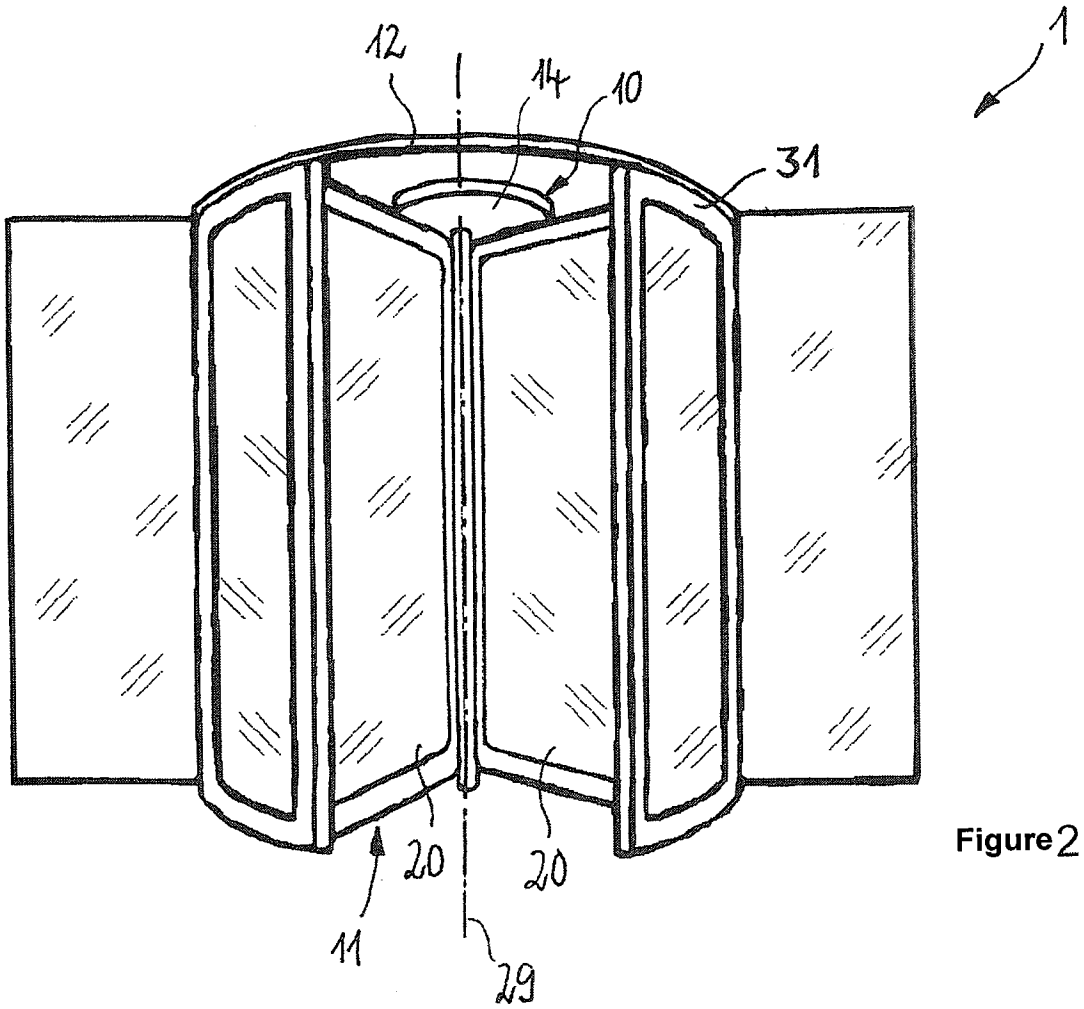
FIG. 2 is a schematic perspective view of the revolving door with a glass ceiling element beneath which the multipole motor is arranged and installed in direct operative connection with the turnstile.

FIG. 2 shows a schematic perspective view of the revolving door 1 with a frame 31 encircling the glass ceiling element 12 arranged on top. A multipole motor 10 arranged below the glass ceiling element 12 drives the turnstile 11 in rotation. A direct connection between the rotor part 14 of the multipole motor 10 and the revolving wings 20 of the turnstile 11 is provided for driving the turnstile 11.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed:

1. A revolving door comprising:

a turnstile;

a gearless drive unit having an electronically commutated multipole motor drivingly connected to the turnstile; and at least one glass ceiling element, wherein the multipole motor is arranged at the glass ceiling element, and wherein connection elements are provided that directly connect a stator part of the multipole motor to the glass ceiling element.

2. The revolving door (1) according to claim 1, wherein the multipole motor (10) is arranged at an underside of the glass ceiling element (12).

3. The revolving door (1) according to claim 1, wherein the multipole motor (10) comprises:

a substantially round, flat base structure;

the stator part (13); and a rotor part (14) arranged in a plane parallel to the stator part (13).

4. The revolving door (1) according to claim 3, wherein the multipole motor (10) comprises:

a plurality of coil elements (15); and a plurality of magnet elements (16), wherein the plurality of coil elements (15) and the plurality of magnet elements (16) are arranged in an area between the stator part (13) and the rotor part (14).

5. The revolving door (1) according to claim 3, wherein the turnstile (11) has revolving wings (20) connected to the rotor part (14), and wherein the revolving wings (20) are arranged at an outer surface (21) of the rotor part (14).

6. The revolving door (1) according to claim 3, wherein the rotor part (14) is received in a bearing-mounted manner at the stator part (13) to be rotatable around a drive axis (29).

7. The revolving door (1) according to claim 6, wherein at least one bearing configured as one of at least one axial bearing (22) and/or at least one radial bearing (23) is arranged between the stator part (13) and the rotor part (14).

8. The revolving door (1) according to claim 1, wherein the connection elements (17) are formed as point-mount glass fasteners.

9. The revolving door (1) according to claim 8, wherein the point-mount glass fasteners are at least a screw element (18) and a sleeve element (19).

10. The revolving door (1) according to claim 9, wherein the sleeve element (19) is guided through an opening (24) in the stator part (13), and the screw element (18) has a conical head (25) that is inserted into a conical receptacle (26) in the glass ceiling element (12).

11. The revolving door (1) according to claim 1, wherein the electronically commutated multipole motor (10) further comprises a round, flat base structure, and wherein a ratio of a height of the round, flat base structure of the electronically commutated multipole motor (10) to a diameter of the round, flat base structure of the electronically commutated multipole motor (10) is at least 1:3.

12. The revolving door (1) according to claim 10, wherein the ratio of a height of the round, flat base structure of the electronically commutated multipole motor (10) to a diameter of the round, flat base structure of the electronically commutated multipole motor (10) is at least 1:8.

13. The revolving door (1) according to claim 1, wherein the multipole motor (10) further comprises at least one rotary feedthrough (27) by which electric elements arranged in a stationary manner in the multipole motor (10) are electrically connected by at least one electric lead (28).

* * * * *